United States Patent [19]

Frias, Jr.

[11] 3,999,563

[45] Dec. 28, 1976

[54] COIN COUNTER

[75] Inventor: Raymond Frias, Jr., Rosemead, Calif.

[73] Assignee: Lawrence Peska Associates, Inc., New York, N.Y.

[22] Filed: Mar. 10, 1976

[21] Appl. No.: 665,455

[52] U.S. Cl. ..... 133/8 R

[51] Int. Cl.[2] ..... G07D 9/00

[58] Field of Search ..... 133/1 R, 1 A, 8 R, 8 A, 133/8 B; 53/254

[56] References Cited

UNITED STATES PATENTS

| | | | |
|---|---|---|---|
| 2,527,389 | 10/1950 | Becker | 133/8 R |
| 3,085,378 | 4/1963 | Howard | 133/8 R X |
| 3,093,148 | 6/1963 | Mesthos | 133/8 R |

*Primary Examiner*—Allen N. Knowles

[57] ABSTRACT

This disclosure pertains to a coin counter comprising a cylindrical hollow tube adapted to accept various denominations of coins therein by selectively adjusting the inside diameter of the tube. The cylindrical tube is further adapted with numbered scales on its outermost surface for the different denomination coins which the counter may contain, each scale accurately informing the user as to the quantity and value of the particular denomination coin selected to be contained therein. The coin counter is adapted with an adjustably inwardly projecting tongue such that a selected number of coins may be discharged from within the tube whilst the remainder are held in the tube by the tongue, or facilitating the accurate counting of coins admitted at the input end of the tube.

5 Claims, 4 Drawing Figures

COIN COUNTER

BACKGROUND OF THE INVENTION

1. The Field of the Invention

This invention relates to coin counters and more particularly to that class containing devices which effectively count coins as well as provide means to release a desired number of coins from within the coin enclosing chamber.

2. Description of the Prior Art

The prior art abounds with coin counters which effectively stack and count coins. U.S. Pat. No. 2,527,389 issued Oct. 24, 1950 to W. E. Becker teaches a device adapted with openings in the surface of a cylindrical hollow tube. The user grasps the edges of the coins exposed at one of the openings located at a selected height along the length of the tube, thus allowing a predetermined number of coins beneath to be released and subsequently wrapped in conventional coin wrappers. However, this device does not allow for the retention therein of coins between the discreet locations of the various openings spaced along the longitudinal axis of the tube. U.S. Pat. No. 3,085,378 issued Apr. 16, 1963 to W. W. Howard shows a cylindrical right angle hollow tube having an opening at one end thereof. The user fills the tube to a level which corresponds to a selected point on a monetary scale located on the surface of a transparent plastic tube. A coin wrapper of conventional design is employed to wrap the now counted quantity of coins. This device does not allow for easy, quick retrieval of a small quantity of coins, except by tipping over the entire apparatus, nor does the device accept various denominations of coins. The coin count is determined solely by the visual alignment of the plane of the uppermost surface of the topmost coin intersecting the external scale thereby allowing for error due to parallax aberations in the location of the user's eye relative to the apparatus and the coins therein.

SUMMARY OF THE INVENTION

A primary object of the instant invention is to provide an inexpensive coin counter wherein one assembly may be easily adapted to count coins of the same denomination and then readily changed to count coins of a different denomination.

Another object is to provide a coin counter which allows for the accurate discharge of any desired number of coins therefrom, be it one or two coins or a numbered stack of coins ready for wrapping into coin wrappers.

Still another object is to provide a coin counter fabricated from a transparent material enabling the user to see the level of the coins in the tube and match the coin level with a tongue-like stacked coin separator accurately delineating the total quantity of coins into two discreet quantities, each being adjacent to a separate opening in the tube.

A further object is to provide a means of selecting accurately without parallax effects coin levels within the tube in relation to the numbered scales thereupon.

The present invention comprises a longitudinal vertically standing cylindrical hollow tube adapted with two annular flanges extending radially outwardly at each free end thereof. Three longitudinal slots are provided in the body of the cylindrical tube, two of which are adapted to accept rectangular sheets therein. The longitudinal edges of the two sheets are interposed at varying radial distances intermediate the central longitudinal axis of the hollow cylindrical tube and the internal surfaces thereof, effectively varying the position of two contact points utilized in combination with a third contact line defined by the internal surface of the tube 120° from either slot, permitting thereby stacking of a quantity of similarly denominated coins at their periphery into a neat vertical column. The third slot is adapted with a bracket which is slidably adjustable along substantially the entire longitudinal length thereof. The bracket houses a tongue urged inwardly by a helical spring. The user can select a storage position for the knife edge of the tongue as it is maintained outwardly from the innermost surface of the wall of the tube. Alternatively, the user may permit the spring to urge the tongue edge into the confines of the hollow tube thereby selecting a quantity of coins by separating the coins stacked within the tube utilizing the knife edge as a coin separator. Coin count and monetary scales are provided on the outermost surface of the tube for the denominations of coins to be handled in the counting and storage process therein. The scales are located adjacent the third slot providing accurate indexing points for the tongue support, eliminating thereby parallax effects in the process of selecting a tongue level. Coins may be stored within the tube by passing through either opening. Coins may be removed from the storage or counting position within the tube by removal through either opening. The device, when rested upon a horizontal surface, stores coins effectively, retaining them until such time that the device is permitted to either extend over a free edge of the horizontal surface or be lifted vertically upwardly therefrom enabling coins to freely drop out of the lowermost opening.

DESCRIPTION OF THE PREFERRED EMBODIMENT

The structure and method of fabrication of the present invention is applicable to a coin counter made of a longitudinal transparent cylindrical hollow plastic tube adapted with a transverse annular flange secured at each open end. The cylindrical tube has three parallel slots extending the entire length thereof. A rectangular sheet having parallel spaced notches extending parallel to the length thereof in both of its lateral surfaces is adapted to be inserted within each of the two longitudinal slots that have notch grasping detenting projections thereon. The projections on the longitudinal slot edges extend into the sheet notches in such a manner as to enable the user to selectively position the inwardmost edge of the sheet as desired positions intermediate the central longitudinal axis of the tube and the innermost surfaces thereof.

The third slot is adapted with a slidable L shaped bracket enabling the selective positioning of the L shaped bracket substantially along the entire length of the slot. The side edges of this slot and the portion of the bracket in contact therewith are adapted with complementary tongues and grooves. The L shaped bracket supports a shaft having a grasping knob at one free end. A knife edge tongue is fitted to the other end of the shaft and maintained in a horizontal position. The shaft is adapted with a projection extending radially outwardly serving the purpose of engaging one end of an inwardly biasing spring and as a locking member adapted to maintain the shaft in an outermost position by rotating the projection into a projection receiving knotch. The other end of the spring engages a part of the L shaped bracket permitting the spring thereby to urge the tongue towards the center of the tube. When the user pulls outwardly on the knob, the spring is compressed in length withdrawing the end of the tongue from the confines of the tube.

Figure 1:
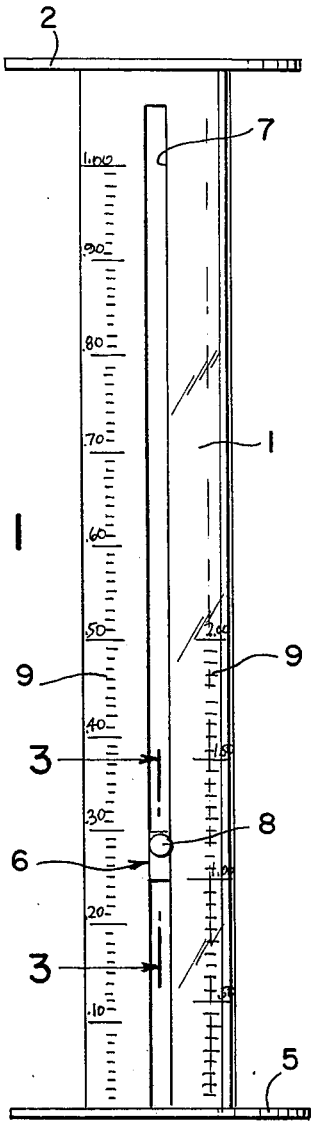
FIG. 1 is a front elevation view of the coin counter.

Now referring to the Figures, and more particularly to the embodiment illustrated in FIG. 1 showing the cylindrical hollow tube 1 comprising the main body of the present invention. The tube has a flange portion 2 at its uppermost end which is adapted with a hole, not shown. Flange 5 is situated at the bottom of the tube containing a hole, not shown, enabling the coins to be discharged therethrough. Slidable bracket 6 is shown attached to slot 7 having a knob 8 extending outwardly. A plurality of scales 9 are denoted on the surface of the tube 1.

Figure 2:
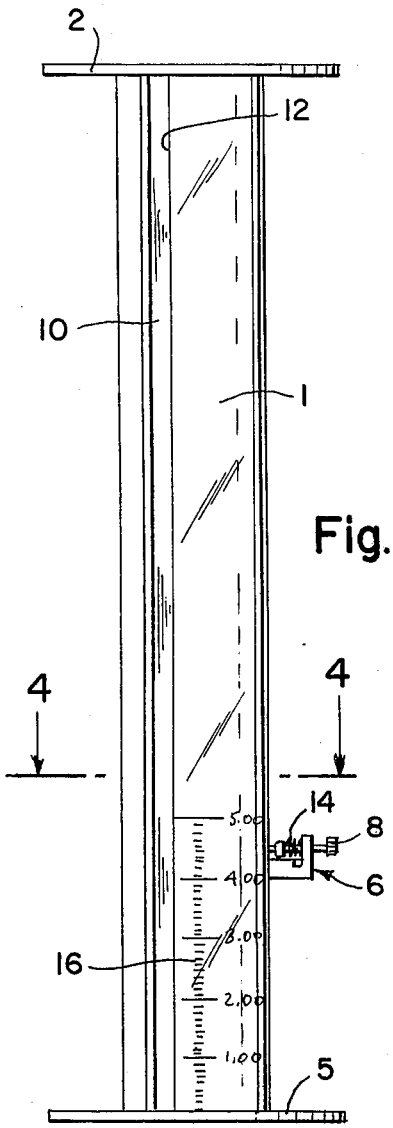
FIG. 2 is a side elevation view of the coin counter as shown in FIG. 1.

FIG. 2 illustrates rectangular sheet 10 which is inserted within a slot 12. Slidable bracket 6 is depicted showing knob 8 and shaft 14 attached thereto. An additional scale 16 is denoted on the surface of tube 1.

Figure 3:
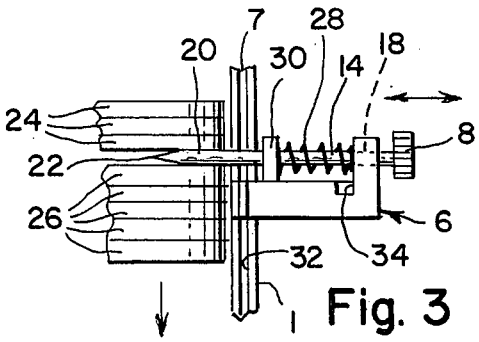
FIG. 3 is a partial cross-sectional view taken along line 3—3 viewed in the direction of arrows 3—3 as shown in FIG. 1 showing the slidable tongue supporting bracket and a tongue interjected between a stack of coins.

FIG. 3 shows the slidable bracket 6 and a portion of cylindrical tube 1. Shaft 14 passes through a hole 18 in one of the legs of L shaped bracket 6 having knob 8 at the exposed end of shaft 14. Tongue 20 is shown with a pointed edge 22 separating coins 24 from coins 26. Helical spring 28 biases projection 30 fastened to shaft 14 inwardly towards the center of tube 1. Grooves 32 in the surface of the edge of slot 7, as shown in FIG. 1, engage a tongue, not shown, projecting outwardly from the other leg of slidable bracket 6. Notches 34 is utilized to engage projection 30 when it is desired to maintain tongue 20 outside of the interior portions of tube 1.

Figure 4:
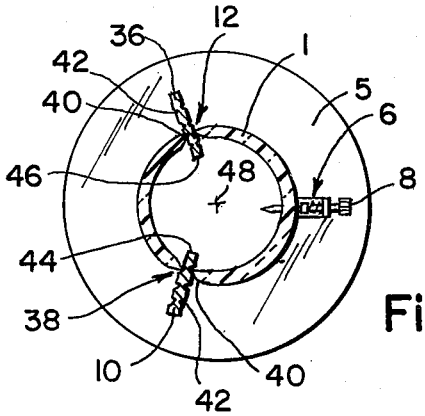
FIG. 4 is a cross-sectional view taken along line 4—4 as viewed in the direction of arrows 4—4 as shown in FIG. 2 illustrating the slidable bracket and two coin diameter accommodating sheets.

FIG. 4 illustrates tube 1 to which slidable bracket 6 is slidably engaged. Sheets 10 and 36 are adapted to engage slots 38 and 12 respectively. Each edge of slots 38 and 12 is tapered to a sharpened knife-like surface 40 adapted to engage the longitudinal knotches 42 in the surface of sheets 10 and 36 so that their innermost edges 44 and 46 may be positioned veriably along radial lines extending from the central axis 48 of the cylindrical tube 1.

One of the advantages is an inexpensive coin counter wherein one assembly may be easily adapted to count coins of the same denomination and then readily changed to count coins of a different denomination.

Another advantage is a coin counter which allows for the accurate discharge of any desired number of coins therefrom, be it one or two coins or a numbered stack of coins ready for wrapping into coin wrappers.

Still another advantage is a coin counter fabricated from a transparent material enabling the user to see the level of the coins in the tube and match the coin level with a tongue-like stacked coin separator accurately deliniating the total quantity of coins into two discreet quantities, each being adjacent to a separate opening in the tube.

A further advantage is a means of selecting accurately without parallax effects coin levels within the tube in relation to the numbered scales thereupon.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims.

The embodiment of the invention in which an exclusive privilege or property is claimed as defined as follows:

I claim:

1. A coin counter comprising a hollow cylindrical tube having three parallel longitudinal slots therein, a flange fixedly secured to each free end of said cylindrical tube having a hole therethrough corresponding in diameter and coincident with the internal diameter of said cylindrical tube, the first of said slots adapted to slidingly engage a coin separating tongue supporting structure therealong, said coin separating tongue adapted with a lateral surface lying in a plane substantially parallel to the lateral surface of said flange and further adapted with bias means to dispose said tongue radially inwardly, the thickness of the edge of said tongue lying closest to the longitudinal axis of said cylindrical tube adapted to be less than the thickness of the remaining portions of said tongue, means to selectively maintain said edge at a point radially outwardly from said internal diameter, a longitudinal sheet adapted to engage the second and third of said slots having a longitudinal edge selectively disposed along lines intermediate and parallel said internal diameter and said longitudinal axis, locking means to selectively maintain said longitudinal edge along said lines, the projections of the edge of said first slot and said longitudinal edge adapted to selectively lie upon the peripheral edge of a coin having a selected diameter.

2. The coin counter as claimed in claim 1 further comprising a longitudinal scale adapted to indicate upon the surface of said tube the monetary value of a number of similarly valued coins longitudinally stacked within the confines of said tube.

3. The coin counter as claimed in claim 1 wherein said three longitudinal slots are disposed apart 120° about the surface of said tube.

4. The coin counter as claimed in claim 1 wherein said locking means comprises a longitudinal notch located along the surface of said longitudinal sheet having an axis parallel to said longitudinal edge, an edge of each of said second and said third slots to be engaged within said notch substantially limiting the ability of said sheet to be moved within said second and said third slots.

5. The coin counter as claimed in claim 1 wherein said cylindrical tube is fabricated from transparent plastic material.

* * * * *